US005755608A

United States Patent [19]

Glickman

[11] Patent Number: 5,755,608

[45] Date of Patent: May 26, 1998

[54] TOP SPINDLE FOR USE WITH CONSTRUCTION TOY

[75] Inventor: Joel I. Glickman, Huntingdon Valley, Pa.

[73] Assignee: Connector Set Limited Partnership, Hatfield, Pa.

[21] Appl. No.: 683,822

[22] Filed: Jul. 18, 1996

[51] Int. Cl.[6] ..... A63H 1/00; A63H 33/04

[52] U.S. Cl. ..... 446/264; 446/256; 446/85

[58] Field of Search ..... 446/264, 265, 446/266, 256, 257, 258, 236, 234, 127, 126, 124, 102, 85

[56] References Cited

U.S. PATENT DOCUMENTS

| | | | |
|---|---|---|---|
| D. 212,956 | 12/1968 | Lohr | 446/256 X |
| D. 217,921 | 6/1970 | Gompes et al. | 446/256 X |
| 361,835 | 4/1887 | Pinnell | 446/266 |
| 668,608 | 2/1901 | Wheeler | 446/256 X |
| 815,591 | 3/1906 | Jones | 446/256 |
| 1,139,119 | 5/1915 | Heidenreich | 446/256 |
| 1,403,200 | 1/1922 | Sandstrom | 446/257 |
| 2,897,066 | 3/1959 | Sutherland | 446/256 X |
| 4,772,241 | 9/1988 | Bro et al. | 446/234 X |
| 5,020,798 | 6/1991 | Yang | 446/257 X |

FOREIGN PATENT DOCUMENTS

| | | | |
|---|---|---|---|
| 470475 | 1/1929 | Germany | 446/256 |
| 1680241 | 9/1991 | U.S.S.R. | 446/236 |

*Primary Examiner*—Robert A. Hafer
*Assistant Examiner*—D. Neal Muir
*Attorney, Agent, or Firm*—Schweitzer Cornman Gross & Bondell LLP

[57] ABSTRACT

A top spindle designed especially for use in connection with parts of a construction toy set, to enable the assembly of spinning tops having a wide variety of inertia members. The spindle includes a main stem provided with an integral support platform. A symmetrically arranged pair of drive lugs project upwardly from the support platform. The stem includes a locating and gripping hub adjacent to the platform and adapted to receive and tightly grip the central hub opening of a construction part from the construction toy set, such parts being in the form of wheels, pulleys, gears or connector elements. Such construction parts are pressed onto the retaining hub, after being positioned such that the upwardly projecting drive lugs engage drive openings in the construction part. Where the construction part is a connector element, that element may form a structural nucleus for the assembly of inertia elements of various sizes and shapes limited only by the imagination of the builder and the requirement that the inertia element be symmetrically balanced about the axis of the spindle.

7 Claims, 2 Drawing Sheets

TOP SPINDLE FOR USE WITH CONSTRUCTION TOY

RELATED APPLICATIONS

This application is related to the subject matter of U.S. Pat. No. 5,061,219, U.S. Pat. No. 5,137,486, U.S. Pat. No. 5,199,919 and U.S. Pat. No. 5,350,331 owned by Connector Set Limited Partnership, d/b/a K'NEX Industries. The disclosures of these patents is incorporated herein by reference.

BACKGROUND AND SUMMARY OF THE INVENTION

The subject matter of the before-mentioned patents relates to multi-part construction toys, and more particularly to a style of construction toy marketed under the trademark "K'NEX". The K'NEX construction toy system utilizes a plurality of rod-like struts of various predetermined lengths that can be joined with connector elements to form a structural assembly. As described in more detail in the above mentioned U.S. patents, the connector elements form radially disposed sockets, defined by spaced-apart gripping arms. The sockets are open at both sides and accommodate a lateral snap-in attachment of the rod-like elements in a unique and advantageous manner whereby the rod elements are firmly held in axial alignment with the radially disposed sockets and are also retained tightly in position against axial motion with respect to the sockets. A typical multi-part construction set also includes gears, wheels and pulleys, for example for the construction of motor driven and/or manually operated mechanisms.

The present invention is directed to a novel top spindle, which is designed for advantageous association with the component parts of a construction toy set of the type described, enabling simple spinning top devices to be constructed, utilizing wheels or gears, for example, as the rotational inertia elements, and also accommodating the assembly of relatively more complex spinning top structures utilizing assemblies of rods and connectors in a wide variety of ways such that an almost endless variety of rotating top devices can be constructed and operated.

In the standard "K'NEX" construction set as currently marketed, rotational elements, such as wheels, pulleys and gears typically are provided with a central opening of a size to freely receive a rod, so that the rod can serve as an axle. Additionally, the construction sets are provided with special drive elements, which can be applied to the rods at any intermediate point along their length and are thereby fixed to the rods for rotation therewith. These drive elements are provided with a drive lug, extending parallel to the axis of the rod to which the drive element is attached. Each of the wheels, pulleys and gears is provided with recesses, typically in the form of through openings, spaced radially from the central axis and arranged to receive the drive lug of a drive element. When the wheels, pulleys or gears are thus engaged with the drive elements, they are rotationally locked together with the rod, so that the rod can be used to rotate the wheel or other element, or vice versa. Advantageously, the lug-engaging recesses are provided in opposed pairs on the wheels, pulleys and gears.

The top spindle device of the present invention is designed to provide an elongated spindle stem having a tapered, rounded tip at one end and a support platform adjacent to the tapered end. The support platform is provided with a pair of upwardly extending drive lugs arranged to engage the drive lug recesses provided in the standard wheels, pulleys or gears of the construction set, so that these latter elements can be locked together with the top spindle to serve as the rotational inertia elements for a spinning top device.

Another standard part of the described construction toy set is a connector element of generally flat configuration having a central hub surrounded by eight radially disposed pairs of gripping arms forming radially disposed rod-receiving sockets. These sockets are defined in part by inner end walls which are connected together at their edges and form an octagonal wall structure surrounding the central hub and spaced therefrom. The adjoining edges of each of the end walls are connected to the hub by radially extending support webs. These webs, in conjunction with the octagonally arranged socket end walls and the central hub, form a plurality of trapezoidal recesses immediately surrounding the central hub. The top spindle device of the invention is arranged so that an eight-socket connector element can be assembled with the top spindle, with the drive lugs of the spindle projecting into an opposed pair of trapezoidal recesses, for rotationally locking the connector device to the top spindle. As contemplated by the invention, a wide variety of structural assemblies may be constructed, utilizing as a central member the eight-socket connector mounted on the top spindle. All kinds and varieties of sizes and shapes of spinning structures may be assembled with the top spindle, as long as any such structure is symmetrical with respect to the axis of the top spindle, and thus balanced for spinning.

In a particularly advantageous embodiment of the invention, the top spindle includes a locating and retaining hub which engages the central hub opening of the part installed thereon (e.g., wheel, pulley, gear, or connector) with an interference fit, so that the inertia member installed on the top spindle is tightly secured thereon for normal usage and is accurately aligned with the spinning axis of the top spindle. Additionally, a preferred form of the top spindle includes an aligning hub immediately adjacent and above the locating and retaining hub and forming therewith a shoulder. The diameter of the aligning hub is such that the central hub opening of an inertia member can be freely received thereover, with the inertia member being aligned with the spindle axis but being easily rotatable with respect to the top spindle, while being supported at the level of or slightly below by the aforementioned shoulder. This arrangement facilitates initial rotation of the inertia member to align its drive recesses with the drive lugs of the spindle, after which the inertia member may be pushed downward over the locating and retaining hub, causing the parts to be tightly secured together in a fixed relationship.

For a more complete understanding of the above and other features and advantages of the invention, reference should be made to the following detailed description of a preferred embodiment of the invention and to the accompanying drawings.

DESCRIPTION OF PREFERRED EMBODIMENTS

Figure 3:
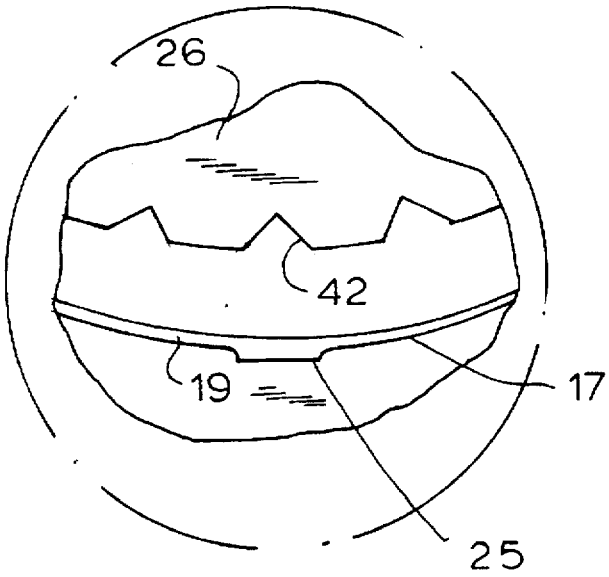
FIG. 3 is a highly enlarged, fragmentary cross sectional view, as taken generally on line 3—3 of FIG. 2 showing details of the area circled in broken lines in FIG. 2.
Figure 1:
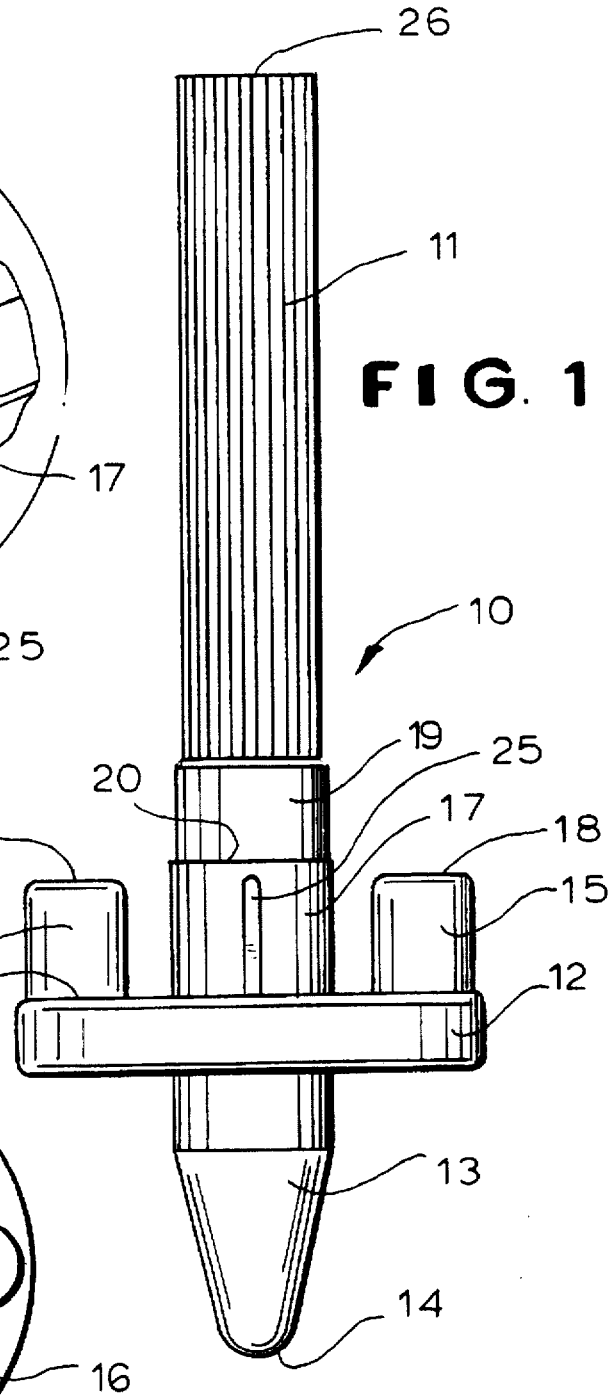
FIG. 1 is a side elevational view of an advantageous form of top spindle according to the present invention for use particularly in connection with a K'NEX multi-part construction toy.
Figure 2:
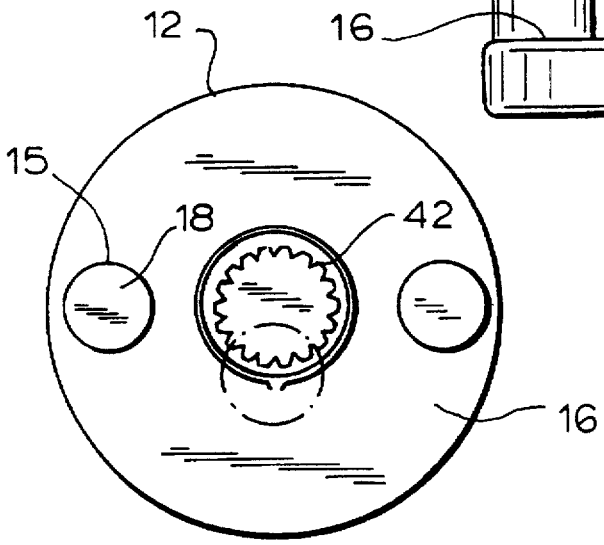
FIG. 2 is a top plan view of the top spindle of FIG. 1.

Referring now to the drawing, and initially to FIGS. 1–3 thereof, the top spindle device of the invention, indicated generally by the reference numeral 10, is a unitary, precision molded item, preferably formed of a high impact plastic materials, such as ABS. The spindle is comprised of an elongated gripping stem 11, forming the upper portion of the spindle, a support platform 12 and a spinning tip 13. Although specific dimensions are not critical, in a typical preferred embodiment of the invention, the overall length of the top spindle may be somewhat over two inches, and the principal diameter may be somewhere around one quarter of an inch. These general dimensions make the item advantageously proportioned for use in combination with parts of a K'NEX construction set.

As shown in FIG. 1, the spinning tip 13 tapers downwardly to a spherically rounded end extremity 14. The support platform 12 is spaced above the tip 14, for example, by distance of about one half inch. The illustrated platform is circular and concentric with the axis of the spindle, having a diameter of about three quarters of an inch. A pair of diametrically opposed drive lugs 15 project upwardly from the upper surface 16 of the support platform a short distance, for example about 3/16 of an inch. The drive lugs are adapted to have cooperative driving engagement with elements of a K'NEX construction toy set. To this end, the spacing and diameter of the drive lugs desirably is held to rather close tolerances. In a particularly preferred form of the invention, the center to center spacing between drive lugs desirably is 0.554 inch plus or minus 0.001, and the diameter of the respective lugs desirably is 0.156 inch plus or minus 0.001. This assures a reliable, effective drive connection with elements of a K'NEX construction toy set.

In the spindle top device of the invention, a locating and retaining hub 17 extends upward from the support platform 12 to a level just slightly above the upper end surfaces 18 of the drive lugs, where it joins with a guide hub 19 of slightly smaller diameter than the locating and retaining hub 17. Where the respective hubs 17, 19 join, a small shoulder 20 is formed.

In a particularly preferred embodiment of the invention, the drive lugs 15 may have a height of approximately 3/16 of an inch, while the retaining hub 17 may have a height of about 0.223, locating the shoulder 20 approximately 0.035 inch above the tops of the driving lugs 15.

Figure 5:
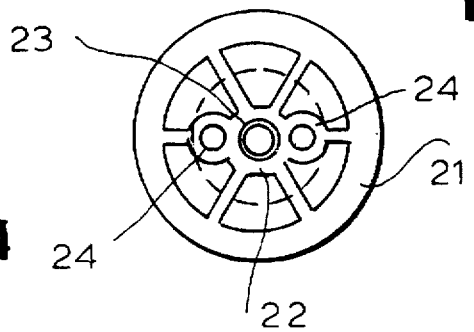
FIGS. 4 and 5 are side elevation and top plan views respectively of the spindle top of FIG. 1 assembled with a wheel or pulley device, for example, of a multi-part construction set, to form a simple spinning top device.
Figure 4:
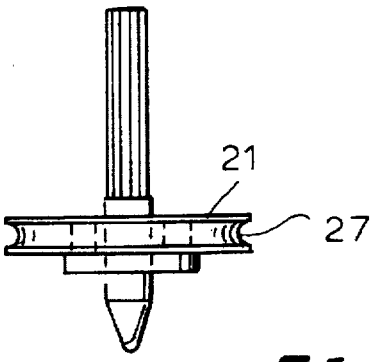

In its most preferred embodiment, the spindle device of FIG. 1 is adapted to be assembled with selected parts of a K'NEX construction set, which parts are provided with a central hub with a through opening having a diameter of 0.251 inch plus or minus 0.001. One typical form of such construction set element is a wheel or pulley 21, as shown in FIGS. 4 and 5. Such an element has a hub 22 with a central opening 23 of the dimensions indicated. In addition, the wheel 21 is provided with diametrically opposed drive openings 24 having a center to center spacing and diameter corresponding to those mentioned above for the drive lugs 15 of the spindle.

To advantage, the locating and retaining hub 17 is provided with a pair of diametrically opposed gripping lands 25 (see FIG. 3). Whereas the diameter of the retaining hub 17 is nominally one thousandth smaller than the diameter of the construction kit element to be mounted thereon, the distance from one outside surface to the other of the diametrically opposed gripping lands 25 is somewhat greater, advantageously about 0.255 inch plus or minus 0.001.

When assembling the top spindle 10 with, for example, a wheel or pulley device 21 as shown in FIGS. 4 and 5, the central hub opening 23 of the wheel is fitted over the upper end 26 of the gripping stem, and the element is slid down over the guide hub 19 and to or slightly onto the gripping hub 17. The hub opening 23 fits freely over the guide hub 19 and, depending upon specific tolerances, may fit partially onto the retaining hub 17, to a position just contacting, or perhaps just slightly above the upper end surfaces 18 of the drive lugs 15. The construction set part then can be rotated as necessary to align the drive openings 24 with the respective drive lugs 15. When properly aligned, the construction set element is pressed downward over the retaining hub and drive lugs until seated firmly on the support platform 12. Inasmuch as the distance between the outer faces of the opposed gripping lands 25 is greater than the diameter of the hub opening of the construction set part, that part is tightly gripped and held in an assembled relation on the spindle 10.

A typical construction set part contemplated for use with the spindle top of the invention has a nominal thickness of approximately 0.245 inch and thus typically extends slightly above the upper ends of the drive lugs 15 and of the retaining hub 17.

The assembled device, as shown in FIGS. 4 and 5, provides a highly functional but simple spinning top device. Different versions of such a simple form of device, with different spin characteristics, may be constructed by utilizing wheel/pulley elements of different weight and/or outside diameter. In addition by installing tire bands (not shown) in the external circumferential grooves 27 of the element 21, the rotating characteristics of the top spindle device of the invention can be further modified.

In accordance with one aspect of the invention, the top spindle device 10 can be joined with a multi-socket connector element of a K'NEX construction set, enabling the inertia element of a top to be comprised of a relatively complex assembly of construction set parts, which may be varied in endless ways, as long as the assembled structure is symmetrical with respect to its central axis. Thus, in the construction shown in FIGS. 6 and 7, a spindle 10 is joined with an inertia element 30 comprised of an eight position connector 31 of a K'NEX construction set. Such a connector element has a central hub opening 32 of the same general dimensions and tolerances as the wheel element 21 and is thus adapted to be snugly received and firmly retained on the retaining hub 17.

Figure 7:
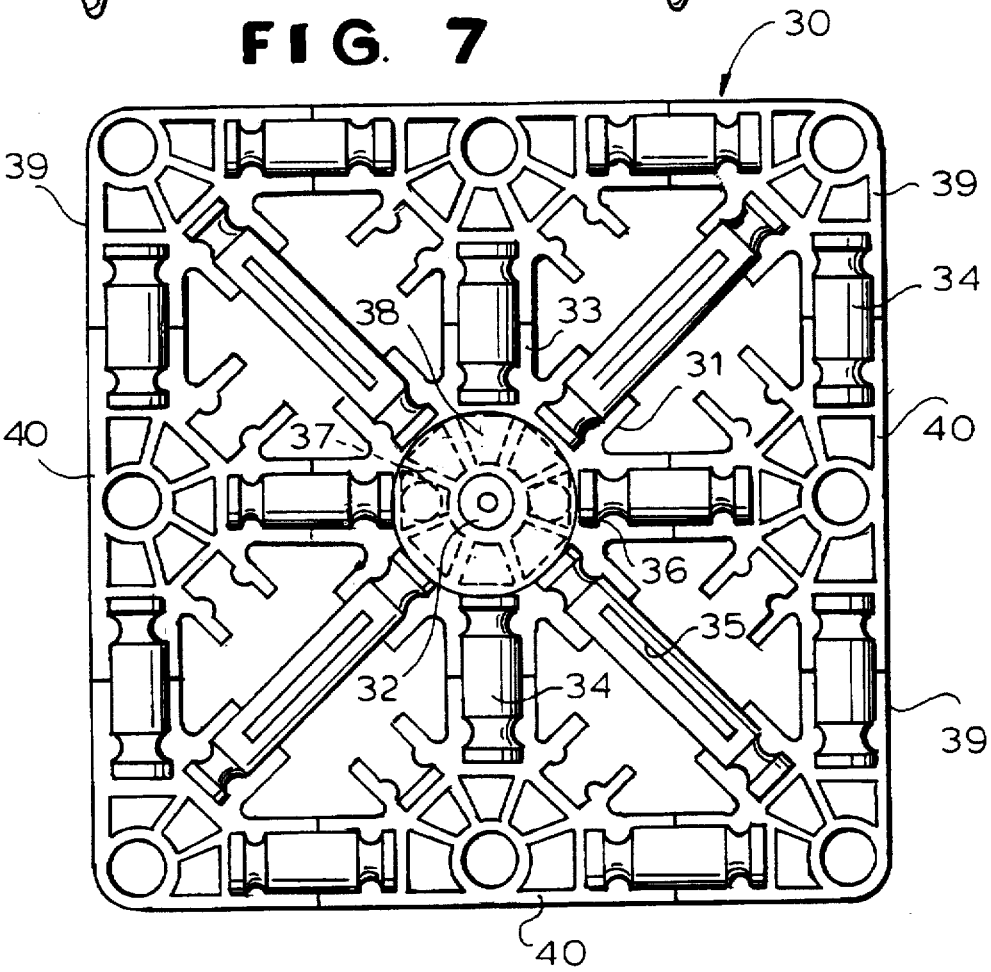

As described in more detail in the previously mentioned U.S. patents, the connector element 31 has eight radially projecting pairs of gripping arms 33, forming sockets open at both sides for the lateral snap-in reception and firm retention of rod-like elements, identified in FIG. 7 by the reference numerals 34, 35. As is evident in FIG. 7, the several rod-receiving sockets are spaced radially outward from the hub opening 32, with the inner end extremities of the sockets being defined by end walls 36 connected at their edges and forming an octagonal configuration. Spoke-like support webs 37 extend radially from the hub area to the octagonally arranged walls 36, forming trapezoidal openings 38 around the hub of the connector. These trapezoidal openings 38 are of such size and configuration that an opposed pair of them are able to receive and confine the drive lugs 15 of the spindle 10.

As is evident in FIG. 7, when an eight-socket connector is mounted on the spindle, supported by the platform 12 and engaged by the driving lugs 15, the central opening 32 of the connector element is tightly retained held on the retaining hub 17 in the same manner as described in connection with the wheel element 21. The connector element, however, serves as a nucleus element for the construction of a larger inertia element, which can be almost any imaginable shape and design, as long as it remains symmetrical with respect to the axis of the spindle 10. In the illustrated arrangement, a series of three-socket connector elements 39 are positioned at corners of the inertia element 30, which is of square configuration. The three-socket connector elements are joined to intermediately positioned five-socket connector elements 40. Short rod elements 34 connect the central connector element 31 with the several five-socket connector elements 40, and the five-socket connectors are in turn connected to the several three-socket corner connectors 39 by similar short rod elements 34. Longer rod elements 35 extend from the central connector radially outward to the middle socket of the several corner connectors 39.

Figure 6:
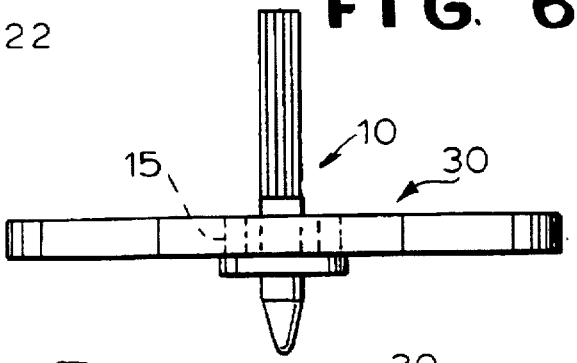
FIGS. 6 and 7 are side elevation and bottom plan views respectively illustrating an assembly of construction set components formed with a central, eight-socket connector, with the connector mounted on the top spindle device to form a spinning top assembly of greater mass and complexity than that shown in FIGS. 4 and 5.

The entire assembly of the inertia element 30, shown in elevation in FIG. 6, is relatively flat, having planar upper and lower surfaces. It is possible, however, and contemplated, that other designs of inertia element may be assembled using standard components of a K'NEX construction set to form inertia members of non-flat configuration, for example with walls or elements projecting upward, either vertically or at an angle.

As indicated in FIG. 7, the diameter of the support platform 12 desirably is slightly less than the distance from the central axis of the connector element 31 to the outer surfaces of the walls 36 forming end walls of the respective rod-gripping sockets. This facilitates construction and modification of inertia elements while the central connector element 31 remains installed on the spindle 10.

Particularly where the inertia element is of considerable size, as exemplary in FIG. 7, there can be considerable inertial resistance to the start up of the spinning of the top. To this end, it is desirable to provide the gripping stem portion of the spindle with longitudinal grooves 42 (FIG. 3).

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A top spindle for use in connection with a construction toy set, wherein the toy set includes one or more construction parts of symmetrical configuration with respect to a central axis of said part and formed with a central opening concentric with said axis and of predetermined diameter and with opposed recesses arranged symmetrically on opposite sides of said axis, said top spindle having a spindle axis and comprising (a) a spinning tip concentric with said spindle axis and forming a lower end extremity of the top spindle, (b) a support platform joined integrally with an upper end portion of said spinning tip and extending laterally with respect to said spindle axis and being symmetrical with respect thereto, (c) a pair of symmetrically arranged drive lugs projecting upwardly from said support platform and engageable with opposed recesses in a construction part supported by said support platform, said drive lugs being adapted to prevent rotation of said construction part about said spindle axis relative to said spindle top, (d) a gripping stem concentric with said spindle axis connected to said support platform and extending upward therefrom above said construction part to enable manual spinning of said spindle and a construction part supported thereon, (e) said spindle including locating and retaining hub concentric with said spindle axis and extending upward from said support platform for a distance to project into the central opening of said construction part supported on said support platform, (f) said locating and retaining hub having an internal configuration such as to have an interference fit with the central opening of said construction part, whereby said construction part, forming an inertia element, is accurately concentrically positioned on said top spindle and is firmly frictionally retained thereon for repetitive spinning of an assembly of said spindle and construction part, and (g) said gripping stem having a maximum diameter less than said locating and retaining hub.

2. A top spindle according to claim 1, wherein (a) said spindle includes a guide hub concentric with said spindle axis and extending upward from said locating and retaining hub, (b) said guide hub having a diameter slightly less than the internal diameter of the central opening of a construction part, whereby said guide hub serves to locate said construction part coaxially with respect to said spindle while accommodating rotation of said construction part relative to said spindle for initial alignment of said drive lugs and said recesses.

3. A top spindle according to claim 2, wherein (a) said guide hub and said locating and retaining hub are axially adjacent and form a shoulder at a predetermined distance above said support platform, (b) said drive lugs having upper end extremities located slightly below an uppermost portion of said shoulder, whereby a construction part may be supported temporarily at or slightly below said shoulder while being rotated to align said recesses with said drive lugs.

4. A top spindle according to claim 1, wherein (a) said construction part is an eight-socket connector, and (b) one or more pairs of sockets in said connector engage rod-like construction parts extending radially from said sockets an a symmetrical array to form portions of an inertia element.

5. A top spindle according to claim 4, wherein (a) additional construction parts, in the form of connector elements, are connected in pairs to selected ones of said rod-like construction parts in a symmetrical array and form part of said inertial element.

6. A top spindle for use in connection with a construction toy set, wherein the toy set includes one or more construction parts of symmetrical configuration with respect to a central axis and formed with a central opening concentric with said axis and of predetermined diameter and with opposed recesses arranged symmetrically on opposite sides of said axis, said top spindle having a spindle axis and comprising (a) a spinning tip concentric with said spindle axis and forming a lower end extremity of the spindle, (b) a support platform joined integrally with an upper end portion of said spinning tip and extending laterally with respect to said spindle axis and being symmetrical with respect thereto, (c) a pair of symmetrically arranged drive lugs projecting upwardly from said support platform and engageable with opposed recesses in a construction part supported by said support platform, (d) a gripping stem concentric with said spindle axis connected to said support platform and extending upward therefrom above said construction part to enable manual spinning of said spindle and a construction part supported thereon, (e) said spindle includes a locating and retaining hub concentric with said spindle axis and extending upward from said support platform for a distance to project into the central opening of said construction part supported on said support platform, (f) said locating and retaining hub having an internal configuration such as to have an interference fit with the central opening of said construction part, whereby said construction part, forming an inertia element, is accurately concentrically positioned on said top spindle and is firmly frictionally retained thereon for repetitive spinning of an assembly of said spindle and construction part, (g) said locating and retaining hub being precision molded to a nominal diameter very close to the nominal diameter of the central opening of said construction part, and (h) said locating and gripping hub being formed with a plurality of narrow, axially extending gripping lands the outer surfaces of which have an interference fit with said central opening for tightly gripping said construction part.

7. A top spindle for use in connection with a construction toy set, wherein the toy set includes one or more construction parts of symmetrical configuration with respect to a central axis and formed with a central opening concentric with said axis and of predetermined diameter and with opposed recesses arranged symmetrically on opposite sides of said axis, said top spindle having a spindle axis and comprising (a) a spinning tip concentric with said spindle axis and forming a lower end extremity of the spindle, (b) a support platform joined integrally with an upper end portion of said spinning tip and extending laterally with respect to said spindle axis and being symmetrical with respect thereto, (c) a pair of symmetrically arranged drive lugs projecting upwardly from said support platform and engageable with opposed recesses in a construction part supported by said support platform, (d) a gripping stem concentric with said spindle axis connected to said support platform and extending upward therefrom above said construction part to enable manual spinning of said spindle and a construction part supported thereon, and (e) said construction part is a wheel-like element.

* * * * *